US005492638A

United States Patent [19]

Wallace et al.

[11] Patent Number: 5,492,638

[45] Date of Patent: Feb. 20, 1996

[54] GEAR OIL LUBRICANTS OF ENHANCED FRICTION PROPERTIES

[75] Inventors: Graeme M. Wallace; Julia C. Poat, both of Wokingham, England

[73] Assignee: Ethyl Petroleum Additives Limited, Berkshire, England

[21] Appl. No.: 203,817

[22] Filed: Mar. 1, 1994

[30] Foreign Application Priority Data

Mar. 16, 1993 [GB] United Kingdom ..... 9305417

[51] Int. Cl.[6] ..... C10M 137/10; C10M 135/10

[52] U.S. Cl. ..... 252/18; 252/32.007 E; 252/45; 252/49.006

[58] Field of Search ..... 252/18, 49.6, 32.7 E, 252/45

[56] References Cited

U.S. PATENT DOCUMENTS

| | | | |
|---|---|---|---|
| 4,218,330 | 8/1980 | Shubken | 252/46.6 |
| 4,917,809 | 4/1990 | Zinke et al. | 252/49.8 |
| 5,037,567 | 8/1991 | Farng et al. | 252/46.7 |
| 5,110,488 | 5/1992 | Lipton et al. | 252/49.6 |
| 5,135,670 | 8/1992 | Johnson et al. | 252/45 |
| 5,262,076 | 11/1993 | Ishida et al. | 252/52 A |
| 5,326,488 | 7/1994 | Minokami et al. | 252/47.5 |

*Primary Examiner*—Jacqueline V. Howard
*Attorney, Agent, or Firm*—Dennis H. Rainear; William H. Thrower

[57] ABSTRACT

The frictional properties of gear oils are improved by including at least one overbased alkali or alkaline earth metal carboxylate, sulphonate or sulphurized phenate having a TBN of at least 200 in a gear oil which comprises: oil of lubricating viscosity at least 80% by volume of which is mineral oil, synthetic ester oil or a mixture thereof; Mannich base ashless dispersant; metal-free, sulphur-containing antiwear and/or extreme pressure agent; and metal-free, phosphorus-containing and nitrogen-containing antiwear and/or extreme pressure agent. The resultant gear oils exhibit excellent performance when used in synchromesh-based transmissions.

8 Claims, No Drawings

GEAR OIL LUBRICANTS OF ENHANCED FRICTION PROPERTIES

This invention relates to gear oil lubricants and gear oil lubricant concentrates having a well-balanced set of performance characteristics, including enhanced frictional properties.

Heretofore, additive concentrates comprising the combination of one or more Mannich base ashless dispersants, one or more metal-free sulphur-containing antiwear and/or extreme pressure agents and one or more metal-free phosphorus-containing and nitrogen-containing antiwear and/or extreme pressure agents have given excellent results when utilized in formulating API GL-4 and GL-5 gear lubricants. These gear oils exhibit excellent antiwear and extreme pressure performance in the operation of gears under high-speed, shock-load; high-speed, low-torque; and low-speed, high-torque conditions. In addition, such lubricants provide excellent results in the CRC L-60 oxidation stability test, often referred to as the "clean-gear test". A complete description of such additive concentrates and lubricant compositions is given in published European patent application Publication Number EP 531 585.

There is however one set of conditions wherein the frictional properties of such additive concentrates and lubricant compositions can be somewhat deficient. When used in synchromesh-based transmissions, the frictional properties of such lubricants can result in noisy gear changes. This deficiency is particularly manifested when subjecting the lubricant to standard synchronizer tests such as the test referred to hereinafter as the "Synchronizer Test".

A need exists, therefore, for a way of improving the frictional properties of such lubricants without material adverse effect upon their otherwise excellent performance characteristics and properties. This invention is deemed to fulfill this need in a most efficient manner.

Pursuant to this invention, there is provided a gear oil which comprises at least the following components:

a) oil of lubricating viscosity comprising at least 80% by volume of mineral oil or synthetic ester oil or a blend thereof;

b) at least one Mannich base ashless dispersant;

c) at least one metal-free, sulphur-containing antiwear and/or extreme pressure agent;

d) at least one metal-free, phosphorus-containing and nitrogen-containing antiwear and/or extreme pressure agent; and e) at least one overbased alkali or alkaline earth metal carboxylate, sulphonate or sulphurized phenate having a TBN of at least 200;

said lubricant containing at most, if any, 100 ppm of metal as one or more metal-containing additive components other than said component e). Use of overbased lithium, sodium, potassium, magnesium and/or calcium carboxylates, sulphonates or sulphurized phenates is preferred, with the overbased calcium carboxylates, sulphonates and calcium sulphurized phenates being particularly preferred. Of the foregoing, the overbased calcium sulphurized phenates are most preferred.

The amount of the overbased alkali and/or alkaline earth metal carboxylate, sulphonate, and/or sulphurized phenate present in the gear oil composition sufficient to improve the friction properties of the lubricant composition as reflected for example in the Synchronizer Test is susceptible to variation depending upon such factors as the type and viscosity of the base oil used in the formulation and the makeup of the particular additive complement utilized therein. For example, if the lubricant has enhanced lubricity because of the presence in the oil of a small amount of a friction modifier system, the amount of the overbased alkali and/or alkaline earth metal component of this invention will normally be somewhat higher than otherwise required. Generally speaking, however, the amount of component e) will be such as to provide the following amounts of alkali or alkaline earth metal based on the weight of the finished lubricant:

Lithium: 0.002 to 0.035 wt %, preferably 0.003 to 0.018 wt %, and most preferably 0.004 to 0.018 wt %.

Sodium: 0.007 to 0.115 wt %, preferably 0.010 to 0.058 wt %, and most preferably 0.014 to 0.058 wt %.

Potassium: 0.012 to 0.20 wt %, preferably 0.017 to 0.098 wt %, and most preferably 0.024 to 0.098 wt %.

Magnesium: 0.007 to 0.12 wt %, preferably 0.010 to 0.06 wt %, and most preferably 0.015 to 0.06 wt %.

Calcium: 0 012 to 0 20 wt % preferably 0 017 to 0 10 wt %, and most preferably 0.025 to 0.1 wt %.

Use can be made of amounts of strontium or barium-containing overbased components yielding proportionate weights of strontium or barium in the finished lubricant (proportionate on an atomic weight basis to the weights listed above for the individual alkali and alkaline earth metal contents of the finished lubricants), although the use of strontium and/or barium components is decidedly less preferable. When two or more alkali and/or alkaline earth metal overbased carboxylates, sulphonates and/or sulphurized phenates are used, the total amount of these metals provided to the finished oil should also be proportionate on an atomic weight basis to the weights listed above for the individual alkali and alkaline earth metal contents of the finished lubricants.

The finished gear oils of this invention typically have a TBN of less than 5. TBN is expressed herein in terms of milligrams of KOH per gram of sample.

Another embodiment of this invention resides in additive concentrates which comprise at least above components b), c), d) and e) dissolved in one or more inert diluents such as light mineral oil. Other embodiments of this invention will become apparent from a consideration of the ensuing description and appended claims.

Base Oil.

Suitable mineral oils include those of appropriate viscosity refined from crude oil of any source including Gulf Coast, Midcontinent, Pennsylvania, California, Alaska, Middle East, North Sea and the like. Standard refinery operations may be used in processing the mineral oil. Among the general types of petroleum oils useful in the compositions of this invention are solvent neutrals, bright stocks, cylinder stocks, residual oils, hydrocracked base stocks, paraffin oils including pale oils, and solvent extracted naphthenic oils. Such oils and blends of them are produced by a number of conventional techniques which are widely known by those skilled in the art. Small amounts (e.g., 20% by volume or less) of non-ester synthetic oils of suitable viscosity and stability (e.g., suitable hydrogenated α-olefin oligomer oils) or natural oils of suitable viscosity and stability (e.g., suitable animal or vegetable oils) can be included in the base oil compositions provided that the base oil retains the properties required for use as a base oil for gear usage.

Synthetic ester oils which can be used include esters of dicarboxylic acids (e.g., phthalic acid, succinic acid, maleic acid, azelaic acid, suberic acid, sebacic acid, fumaric acid, adipic acid, linoleic acid dimer) with a variety of alcohols (e.g., butyl alcohol, hexyl alcohol, dodecyl alcohol, 2-ethylhexyl alcohol, ethylene glycol). Specific examples of these esters include dibutyl adipate, di(2-ethylhexyl) adipate, didodecyl adipate, di(tridecyl) adipate, di(2-ethylhexyl) sebacate, dilauryl sebacate, di-n-hexyl fumarate, dioctyl sebacate, diisooctyl azelate, diisodecyl azelate, dioctyl phthalate, didecyl phthalate, di(eicosyl) sebacate, the 2-ethylhexyl diester of linoleic acid dimer, and the complex ester formed by reacting one mole of sebacic acid with two moles of tetraethylene glycol and two moles of 2-ethylhexanoic acid. Other synthetic esters which may be used include those made from $C_3$–$C_{18}$ monocarboxylic acids and polyols and polyol ethers such as neopentyl glycol, trimethylolpropane, pentaerythritol and dipentaerythritol. Trimethylol propane tripelargonate, pentaerythritol tetracaproate, the ester formed from trimethylolpropane, caprylic acid and sebacic acid, and the polyesters derived from a $C_4$–$C_{14}$ dicarboxylic acid and one or more aliphatic dihydric $C_3$–$C_{12}$ alcohols such as derived from azelaic acid or sebacic acid and 2,2,4-trimethyl-1,6-hexanediol serve as examples.

Blends of one or more mineral oils with one or more synthetic ester oils can be used. Preferably the base oil is predominantly hydrocarbonaceous in character. Base oils made up entirely of mineral oils are most preferred.

Ordinarily, the base oil will have a kinematic viscosity at 100° C. falling in the range of 4.1 to 41 cSt, and preferably in the range of 7.0 to 24 cSt.

Mannich Base Dispersants.

As is well known, Mannich base dispersants are condensation products formed by condensing a long chain hydrocarbon-substituted phenol with one or more aliphatic aldehydes, usually formaldehyde or a formaldehyde precursor, and one or more polyamines, usually one or more polyalkylene polyamines. For use in the practice of this invention, the resultant Mannich base is preferably (but not necessarily) boronated (sometimes called "borated") by reaction with a suitable boron compound such a boron acid, a boron ester, a boron oxide, a salt of a boron acid, a super-boronated ashless dispersant, or the like.

Examples of Mannich condensation products, including in many cases boronated Mannich base dispersants, and methods for their production are described in the following U.S. Pat. Nos.: 2,459,112; 2,962,442; 2,984,550; 3,036,003; 3,166,516; 3,236,770; 3,368,972; 3,413,347; 3,442,808; 3,448,047; 3,454,497; 3,459,661; 3,493,520; 3,539,633; 3,558,743; 3,586,629; 3,591,598; 3,600,372; 3,634,515; 3,649,229; 3,697,574; 3,703,536; 3,704,308; 3,725,277; 3,725,480; 3,726,882; 3,736,357; 3,751,365; 3,756,953; 3,793,202; 3,798,165; 3,798,247; 3,803,039; 3,872,019; 3,904,595; 3,957,746; 3,980,569; 3,985,802; 4,006,089; 4,011,380; 4,025,451; 4,058,468; 4,083,699; 4,090,854; 4,354,950; and 4,485,023.

Preferably, the Mannich base employed includes or, alternatively, consists of boronated Mannich base ashless dispersants.

For further details, reference may be had to EP 531 585 referred to above.

Sulphur-Containing Antiwear and/or Extreme Pressure Agents.

A variety of oil-soluble metal-free sulphur-containing antiwear and/or extreme pressure additives can be used in the practice of this invention. Examples are included within the categories of dihydrocarbyl polysulphides; sulphurized olefins; sulphurized fatty acid esters of both natural and synthetic origins; trithiones; sulphurized thienyl derivatives; sulphurized terpenes; sulphurized oligomers of $C_2$–$C_8$ monoolefins; and sulphurized Dieis-Alder adducts such as those disclosed in U.S. reissue patent Re 27,331. Specific examples include sulphurized polyisobutene of Mn 1,100, sulphurized isobutylene, sulphurized diisobutylene, sulphurized triisobutylene, dicyclohexyl polysulphide, diphenyl polysulphide, dibenzyl polysulphide, dinonyl polysulphide, and mixtures of di-tert-butyl polysulphide such as mixtures of di-tert-butyl trisulphide, di-tert-butyl tetrasulphide and di-tert-butyl pentasulphide, among others.

Combinations of such categories of sulphur-containing antiwear and/or extreme pressure agents can also be used, such as a combination of sulphurized isobutylene and di-tert-butyl trisulphide, a combination of sulphurized isobutylene and dinonyl trisulphide, a combination of sulphurized tall oil and dibenzyl polysulphide, and the like.

Reference should be had to EP 531 585 referred to above for further details concerning this component.

Phosphorus-Containing Antiwear and/or Extreme Pressure Agents.

For purposes of this invention a component which contains both phosphorus and sulphur in its chemical structure is deemed a phosphorus-containing antiwear and/or extreme pressure agent rather than a sulphur-containing antiwear and/or extreme pressure agent.

Although use can be made of a wide variety of oil-soluble substances such as the oil-soluble organic phosphates, organic phosphites, organic phosphonates, organic phosphonites, etc., and their sulphur analogs, the preferred phosphorus-containing antiwear and/or extreme pressure agents for use in the compositions of this invention are those which contain both phosphorus and nitrogen.

One such type of phosphorus- and nitrogen-containing antiwear and/or extreme pressure additives which can be employed in the practice of this invention are the phosphorus- and nitrogen-containing compositions of the type described in G.B. 1,009,913; G.B. 1,009,914; U.S. Pat. No. 3,197,405 and/or U.S. Pat. No. 3,197,496. In general, these compositions are formed by forming an acidic intermediate by the reaction of a hydroxy-substituted triester of a phosphorothioic acid with an inorganic phosphorus acid, phosphorus oxide or phosphorus halide, and neutralizing a substantial portion of said acidic intermediate with an amine or hydroxy-substituted amine.

Another type of phosphorus- and nitrogen-containing antiwear and/or extreme pressure additive which can be used in the compositions of this invention is the amine salts of hydroxy-substituted phosphetanes or the amine salts of hydroxy-substituted thiophosphetanes. Typically, such salts are derived from compounds of the formula wherein each of $R_1$, $R_2$, $R_3$, $R_4$, $R_5$ and $R_6$ is a hydrogen atom or a carbon-bonded organic group such as a hydrocarbyl group or a substituted hydrocarbyl group wherein the substituent(s) do(es) not materially detract from the predominantly hydrocarbonaceous character of the hydrocarbyl group; X is a sulphur or an oxygen atom and Z is a hydroxyl group or an organic group having one or more acidic hydroxyl groups. Examples of this general type of antiwear and/or extreme pressure agent include the amine salts hydroxyphosphetanes and the amine salts of hydroxy-thiophosphetanes typified by Irgalube 295 additive (Ciba-Geigy Corporation).

Another useful category of phosphorus- and nitrogen-containing antiwear and/or extreme pressure agents is comprised of the amine salts of partial esters of phosphoric and thiophosphoric acids. The phosphoric and thiophosphoric acids have the formula $$(HX^1)(HX^2)(HX^3)PX^4$$

wherein each of $X^1$, $X^2$, $X^3$ and $X^4$ is, independently, an oxygen atom or a sulphur atom, and most preferably wherein at least three of them are oxygen atoms.

For further details concerning this component, reference should be had to EP 531 585 referred to above.

Overbased Alkali and Alkaline Earth Metal Carboxylate, Sulphonate and/or Sulphurized Phenate.

As pointed out above these components should have a TBN of at least 200 milligrams of KOH per gram of product. Preferably, the TBN of the overbased alkali or alkaline earth metal component is at least 240 and can be as high as 500 to 600 depending upon the makeup of the component. The carboxylates can be alkali or alkaline earth metal salts of alkyl succinic acids or alkenyl succinic acids in which the alkyl or alkenyl substituent contains an average of from 50 to 300 carbon atoms such as a polypropenyl group, a polyisobutenyl group, or the like. Another highly useful type of alkali or alkaline earth metal carboxylate is the alkali and alkaline earth metal salicylates. The overbased sulphonates are exemplified by overbased alkali and alkaline earth metal petroleum sulphonates (sometimes referred to "mahogany sulphonates") and overbased alkali and alkaline earth metal alkylaryl sulphonates such as the alkylbenzene sulphonates and the alkylnaphthalene sulphonates. The overbased sulphurized phenates are typically derivatives of alkylphenols having an alkyl substituent of sufficient chain length (usually $C_8$ or above) to confer suitable oil solubility. Methods for the manufacture of the foregoing overbased alkali and alkaline earth metal carboxylates, sulphonates and sulphurized phenates are extensively reported in the literature. See for example U.S. Pat. Nos. 4,647,387; 4,664,824; 4,698,170; 4,710,308; 4,744,920; 4,744,921; 4,749,499; 4,758,360; 4,775,490; 4,780,224; 4,810,396; 4,810,398; 4,822,502; 4,865,754; 4,869,837; 4,979,053; 4,880,550; 4,929,373; 4,954,272; 4,971,710; 4,973,411; 4,995,993; 4,997,584; 5,011,618; 5,013,463; 5,024,773; 5,030,687; 5,032,299; 5,035,816; 5,069,804; 5,089,155; 5,098,587; 5,108,630; 5,108,631; 5,112,506; 5,132,033; and 5,137,648. Overbased alkaline earth metal calixerates such as described in U.S. Pat. No. 5,114,601 may also be used. Suitable overbased materials are available as articles of commerce from a number of commercial sources.

Other Additives.

The preferred compositions of this invention will also contain one or more additional components such as one or more amine salts of carboxylic acids, amines, trihydrocarbyl dithiophosphates, carboxylic acids, demulsifiers, copper corrosion inhibitors or passivators, supplemental ashless dispersants, antioxidants, rust inhibitors, antifoam agents, seal swell agents, viscosity index improvers, pour point depressants, other metal corrosion inhibitors, and the like. In selecting such materials, care should be taken to ensure that the components are mutually compatible with each other and are essentially metal-free so that the finished lubricant contains no more than 100 ppm, if any, of metal other than the alkali and/or alkaline earth metal of the overbased component e). For further details concerning suitable additives of the foregoing type, reference should be had to EP 531 585 referred to above.

Proportions and Concentrations.

In general, the components of the additive compositions of this invention are employed in minor amounts sufficient to improve the performance characteristics and properties of the base oil or fluid. When employing free amine, the amount employed is most preferably the amount sufficient to render the pH of the finished additive concentrate as formed within the range of 6 to 8. The amounts of the other components will vary in accordance with such factors as the viscosity characteristics of the base oil or fluid employed, the viscosity characteristics desired in the finished product, the service conditions for which the finished product is intended, and the performance characteristics desired in the finished product. However, generally speaking, the following concentrations (weight percent) of the components (active ingredients, i.e., excluding diluents which often are associated therewith) in the base oils or fluids are illustrative:

| | Typical Range | Preferred Range |
|---|---|---|
| Mannich base | 0.1–3 | 0.2–2 |
| S-contg antiwear/E.P. agent | 0.1–6 | 1–4 |
| P-contg antiwear/E.P. agent | 0.1–3 | 0.1–2 |
| Amine salt of carboxylic acid | 0–2 | 0.01–1 |
| Free amine | 0–2 | 0–1 |
| Trihydrocarbyl dithiophosphate | 0–3 | 0–2 |
| Demulsifier | 0–1 | 0–0.2 |
| Cu corrosion inhibitor | 0–0.5 | 0.01–0.2 |
| Other P-antiwear/E.P. agent | 0–0.7 | 0.05–0.4 |
| Supplemental ashless dispersant | 0–3 | 0–2 |
| Antioxidant | 0–2 | 0–1 |
| Supplemental rust inhibitor | 0–2 | 0.02–1 |
| Antifoam agent | 0–0.3 | 0.0002–0.1 |
| Friction modifier | 0–3 | 0–1 |
| Seal swell agent | 0–20 | 0–10 |
| Viscosity index improver | 0–20 | 0–15 |
| Pour point depressant | 0–2 | 0–1 |
| Other metal corrosion inhibitors | 0–1 | 0–0.5 |

It is to be noted that some additives are multifunctional additives capable of contributing more than a single property to the blend in which they are used. Thus when employing a multifunctional additive component in the compositions of this invention, the amount used should of course be sufficient to achieve the function(s) and result(s) desired therefrom.

The individual components can be separately blended into the base oil or fluid or can be blended therein in various subcombinations, if desired. Moreover, such components can be blended in the form of separate solutions in a diluent. Another variant is to employ a so-called top treat wherein one or more components such as the alkali and/or alkali earth metal overbased component e) are added to the base oil separately from an additive concentrate containing other components desired in finished oil. Except for viscosity index improvers and/or pour point depressants (which in many instances are blended apart from other components), it is preferable to blend the other selected components into the base oil by use of an additive concentrate of this invention, as this simplifies the blending operations, reduces the likelihood of blending errors, and takes advantage of the compatibility and solubility characteristics afforded by the overall concentrate.

The additive concentrates of this invention will contain the individual components in amounts proportioned to yield finished oil or fluid blends consistent with the concentrations tabulated above. In most cases, the additive concentrate will contain one or more diluents such as light mineral oils, to facilitate handling and blending of the concentrate. Thus concentrates containing up to 80% by weight of one or more diluents or solvents can be used.

Synchronizer Test.

Tests have been designed for the evaluation of oil performance in commercially available synchromesh units under endurance conditions with the bulk lubricant temperature controlled at a relatively high level. While it is important to simulate fairly closely the actual conditions met in service, the need to produce a test result in an acceptable period had to be taken into account. In these tests, two halves of a transmission synchromesh unit are repeatedly brought together under conditions of known force and speed differential until failure occurs. Failure may be defined in terms of synchromesh performance or overall wear. Test rigs used in the procedure have been designed with consideration of work done by Socin and Walters, SAE Paper Number 680008 entitled "Manual Transmission Synchronizers"; Fano, CEC TLPG4 Chairman's Final Report, 1985, entitled "Synchromesh Test Method With Proposed Synchro Test Rig"; and Brugen, Thies and Naurian of Zahnradfabrik Friedrichshafen A.G. in a paper entitled "Einfluss Des Schmierstoffes auf die Schaltelemente Von Fahrzeuggetrieben". In the test apparatus, the two synchromesh units are assembled in a gear box which forms the oil reservoir and facilitates splash lubrication of components. Drive may be transmitted along the main shaft or via the layshaft gears to give an increased ratio. The input speed is kept constant by means of a DC drive control system and a large flywheel simulating vehicle inertia. On changing gear, the output shaft accelerates and decelerates the small flywheel which simulates clutch inertia. A pivot linkage connected to a pneumatic cylinder provides the actuating force which is measured by means of a load ring strain gauge. A small heater is used to control oil temperature.

Torque transmitted through the output shaft can be measured to give an indication of the coefficient of friction between the synchronizing cones. The synchromesh units used are standard commercially available steel units with a molybdenum-based plasma spray coating on the inner surface of the outer synchroring. The coefficient of friction for satisfactory synchronizer performance in the test is at least 0.065.

Another performance criterion which may be used when performing the test for qualification purposes is bad gear changes as determined by analysis of torque data. For this purpose the control and monitoring of the rig is coordinated by a process controller. During a test, the number of bad changes is recorded. The test is terminated prematurely if this number becomes unacceptable.

The following examples illustrate the practice and advantages of this invention. These examples, in which all parts and percentages are by weight unless otherwise specified, are not intended to limit, and should not be construed as limiting, the practice or scope of this invention.

EXAMPLES

A series of tests were carried out using the Synchronizer Test procedure and utilizing a group of gear oils in which, except for the identity and quantity if any of overbased component e) employed, the additive complement was kept uniform from test to test. The uniform, non-varied portion of the additive complement was an additive concentrate containing 9.33% of a mineral oil concentrate containing 48% of boronated Mannich ashless dispersant; 6.26% of trihydrocarbyl dithiophosphate; 0.50% of antifoam agent; 0.31% of demulsifying agents; 1.20% of copper corrosion inhibitor; 20.83% of process oil diluent; and a mixture of sulphurized isobutylene, amine salts of dibutyl monothiophosphoric acid, amine carboxylates, amine salts of mono- and dialkylphosphoric acid and amines formed by interactions among 44.00% of sulphurized isobutylene, 5.33% of dibutyl hydrogen phosphite, 1.94% of 2-ethylhexyl acid phosphate, 7.80% of aliphatic primary monoamines, and 2.50% of aliphatic monocarboxylic acids. For the tests involving GL-4 gear oil, the above concentrate was employed at a concentration of 3.75% in the base oil. For GL-5 service, the additive concentrate was employed at a treat rate of 7.50%. The base oil used in these tests was high viscosity index 115 solvent neutral base oil (Shell Oil Company) containing 1% of poly(alkyl methacrylate) pour point depressant.

Example 1 (Comparative)

In a control run wherein the additive package was employed at the GL-4 concentration level, and without use of an overbased alkali or alkaline earth metal component e) of this invention, the Synchronizer Test was discontinued after 406 cycles during which 20 bad gear changes had occurred.

Example 2

When 0.15% of overbased calcium sulphurized alkyl phenate in the form of a 62% solution in oil having a nominal TBN of 255, a nominal calcium content of 9.25%, and a nominal sulphur content of 3.4% was included in the composition of Example 1, the finished lubricant successfully completed 5,000 cycles in the Synchronizer Test with no bad gear changes.

Examples 3–5 and Example 6 (Comparative)

The procedure of Example 2 was repeated except that the additive package was employed at the GL-5 dosage level and the overbased calcium sulphurized alkyl phenate solution was employed at dosage levels of 0.30%, 0.35% and 0.50%. In each of these three runs, the lubricants successfully completed 5,000 cycles in the Synchronizer Test with no bad gear changes. It was found in a similar run that the dosage level of 0.20% for the overbased calcium sulphurized alkyl phenate was insufficient to achieve 5,000 cycles of trouble-free gear changes when the additive concentrate was employed at the GL-5 dosage level.

Example 7

The procedure of Example 2 was repeated with the exception that 0.10% of overbased calcium alkyl benzene sulphonate was employed. This material was in the form of a 56% solution in mineral oil and had a nominal TBN of 307, a nominal calcium content of 11.90%, and a nominal sulphur content of 1.70%. This blend achieved 4,539 cycles with 27 bad gear changes and thus the dosage level was less than that needed to achieve trouble-free performance.

Example 8 (Comparative)

The procedure of Example 1 was repeated and in this instance the gear oil formulation was discontinued after 244 cycles with 14 bad gear changes.

Example 9

The procedure of Example 8 was repeated except that 0.50% of the overbased calcium alkyl benzene sulphonate of Example 7 was included in the finished oil composition. In this case, the lubricant successfully passed 5,000 cycles with no bad gear changes having been experienced.

It will be understood and appreciated that the additive components utilized in the compositions of this invention should be oil-soluble. By this is meant the component in question has sufficient solubility in the selected base oil in order to dissolve therein at ordinary temperatures to a concentration at least equivalent to the minimum concentration specified herein for use of such component. Preferably, however, the solubility of such component in the selected base oil will be in excess of such minimum concentration, although there is no requirement that the component be soluble in the base oil in all proportions. As is known to those skilled in the art, certain useful additives do not completely dissolve in base oils but rather are used in the form of stable suspensions or dispersions. Additives of this type can be employed in the compositions of this invention, provided they remain stably dispersed in the finished oil and do not significantly interfere with the performance or usefulness of the composition in which they are employed.

As is well known to those skilled in the art, overbased alkali and alkaline earth metal detergent materials such as the carboxylates, sulfonates, and sulfurized phenates, are provided in the form of oil solutions or concentrates. It will thus be appreciated that all references herein to the TBN of these materials is with reference to the solutions or concentrates as received.

We claim:

1. A method of improving the gear shift performance in a synchromesh transmission which comprises contacting the gears of the synchromesh transmission with a gear oil which comprises at least the following components:

a) oil of lubricating viscosity at ].east 80% by volume of which is mineral oil or synthetic ester oil or a blend thereof;

b) at least one Mannich base ashless dispersant;

c) at least one metal-free, sulphur-containing antiwear and/or extreme pressure agent;

d) at least one metal-free, phosphorus-containing and nitrogen-containing antiwear and/or extreme pressure agent; and e) at least one overbased alkali or alkaline earth metal carboxylate, sulphonate or sulphurized phenate having a TBN of at least 200;

in proportions sufficient to improve the gear shift performance of the synchromesh transmission, said lubricant containing at most, if any, 100 ppm of metal as one or more metal-containing additive components other than said component e).

2. A method in accordance with claim 1 wherein said Mannich base ashless dispersant is a boronated Mannich base ashless dispersant.

3. A method in accordance with claim 2 wherein said metal-free, sulphur-containing antiwear and/or extreme pressure agent is a sulphurized olefin.

4. A method in accordance with claim 3 wherein said metal-free, phosphorus-containing and nitrogen-containing antiwear and/or extreme pressure agent is at least one amine salt of a dihydrocarbyl monothiophosphoric acid, and wherein said component e) is an overbased calcium sulphurized alkyl phenate having a TBN of at least 240 or an overbased calcium alkylbenzene sulphonate having a TBN of at least 300.

5. In a method of increasing the frictional properties of a gear oil lubricant comprising components (i) at least one Mannich base ashless dispersant; (ii) at least one metal-free, sulphur-containing antiwear and/or extreme pressure agent; (iii) at least one metal-free, phosphorus-containing and nitrogen-containing antiwear and/or extreme pressure agent; the improvement comprising the addition to said gear oil lubricant for use in a synchromesh transmission of (iv) at least one overbased alkali or alkaline earth metal carboxylate, sulphonate or sulphurized phenate having a TBN of at least 200 in proportions sufficient to thereby improve the frictional properties of said lubricant in a synchromesh transmission; said lubricant containing at most 100 ppm of metal as one or more metal-containing additive components other than said component (iv).

6. A method in accordance with claim 5 wherein said Mannich base ashless dispersant is a boronated Mannich base ashless dispersant, and wherein said metal-free, sulphur-containing antiwear and/or extreme pressure agent is a sulphurized olefin.

7. A method in accordance with claim 6 wherein said metal-free, phosphorus-containing and nitrogen-containing antiwear and/or extreme pressure agent is at least one amine salt of a dihydrocarbyl monothiophosphoric acid, and wherein said component (iv) is an overbased calcium sulphurized alkyl phenate having a TBN of at least 240 or an overbased calcium alkylbenzene sulphonate having a TBN of at least 300.

8. A method of operating a motor vehicle having a manual sychromesh transmission equipped with at least one cone-type synchronizer, which method comprises employing in said transmission a gear oil which comprises:

a) oil of lubricating viscosity at least 80% by volume of which is mineral oil or synthetic ester oil or a blend thereof;

b) at least one Mannich base ashless dispersant;

c) at least one metal-free, sulphur-containing antiwear and/or extreme pressure agent;

d) at least one metal-free, phosphorus-containing and nitrogen-containing antiwear and/or extreme pressure agent; and e) at least one overbased alkali or alkaline earth metal carboxylate, sulphonate or sulphurized phenate having a TBN of at least 200 in an amount sufficient to raise the coefficient of friction between the synchronizer cones to greater than or equal to 0.065;

in proportions sufficient to improve the gear shift performance of the synchromesh transmission, said gear oil containing at most, if any, 100 ppm of metal as one or more metal-containing additive components other than said component e).

* * * * *

UNITED STATES PATENT AND TRADEMARK OFFICE

CERTIFICATE OF CORRECTION

PATENT NO. : 5,492,638

DATED : February 20, 1996

INVENTOR(S) : Graeme M. Wallace and Julia C. Poat

It is certified that error appears in the above-identified patent and that said Letters Patent is hereby corrected as shown below:

In column 4, between lines 49 and 53, insert the following chemical formula which has been omitted therefrom:

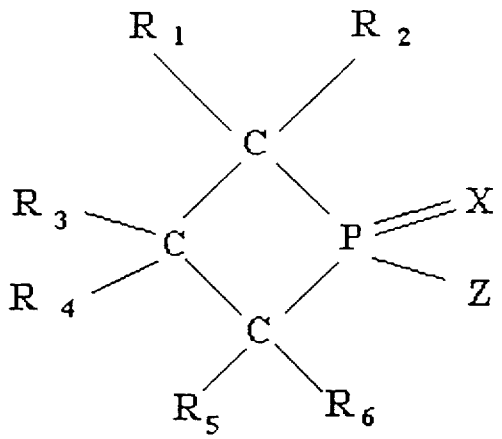

Signed and Sealed this

Twenty-third Day of July, 1996

*Attest:*

*Attesting Officer*

BRUCE LEHMAN

*Commissioner of Patents and Trademarks*